US007447468B2

(12) United States Patent
Nishimura et al.

(10) Patent No.: US 7,447,468 B2
(45) Date of Patent: Nov. 4, 2008

(54) DEVELOPING DEVICE AND IMAGE FORMING DEVICE HAVING THE SAME

(75) Inventors: Ryoji Nishimura, Osaka (JP); Yoshihiro Yamagishi, Mie (JP); Hirohisa Endou, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/725,468

(22) Filed: Mar. 20, 2007

(65) Prior Publication Data

US 2007/0223969 A1 Sep. 27, 2007

(30) Foreign Application Priority Data

Mar. 27, 2006 (JP) ..... 2006-084904
Mar. 27, 2006 (JP) ..... 2006-084905

(51) Int. Cl.
*G03G 15/08* (2006.01)

(52) U.S. Cl. ..... 399/254

(58) Field of Classification Search ..... 399/254–256
See application file for complete search history.

(56) References Cited

U.S. PATENT DOCUMENTS 5,734,952 A * 3/1998 Murakami et al. ..... 399/255
6,055,405 A * 4/2000 Knott et al. ..... 399/358
6,832,067 B2 * 12/2004 Kubo ..... 399/350
2006/0222408 A1 * 10/2006 Suenami et al. ..... 399/254

FOREIGN PATENT DOCUMENTS

JP 04036785 A * 2/1992
JP 05224562 A * 9/1993
JP 2000-250299 A 9/2000
JP 2001-249538 A 9/2001
JP 2006126412 A * 5/2006

* cited by examiner

*Primary Examiner*—David M. Gray
*Assistant Examiner*—Ryan Gleitz
(74) *Attorney, Agent, or Firm*—Shinjyu Global IP

(57) ABSTRACT

A developing device includes a casing, a first mixing conveying screw, and a developer removing unit. The casing is able to store toner. The first mixing conveying screw has a shaft arranged to be able to rotate freely in the interior of the casing, and a spiral in a spiral shape formed on the outer circumference portion of the shaft. The developer removing unit has a plurality of spring members arranged to be lined up in the axial direction corresponding to the spiral pitch of the spiral and are able to contact the spiral, and a retaining member that is retained in the casing and retains the plurality of the spring members.

15 Claims, 6 Drawing Sheets

DEVELOPING DEVICE AND IMAGE FORMING DEVICE HAVING THE SAME

CROSS-REFERENCE TO RELATED APPLICATIONS

This application claims priority to Japanese Patent Application Nos. 2006-084904 and 2006-084905 both filed on Mar. 27, 2007. The entire disclosures of Japanese Patent Application No. 2006-084904 and 2006-084905 are hereby incorporated herein by reference.

BACKGROUND OF THE INVENTION

1. Field of the Invention

The present invention generally relates to a developing device. More specifically, the present invention relates to a developing device and an image forming device having the same.

2. Background Information

An image forming device, such as an electrophotographic copying machine, a printer, and the like, has a photosensitive drum (image carrier), and a developing device that provides developer to the photosensitive drum and makes the electrostatic latent image visible. The developing device generally has a casing that stores developer, a developing roller that is arranged opposite the photosensitive drum in the interior of the casing, and a mixing conveying screw (mixing conveying member) that mixes and conveys developer in the interior of the casing. The mixing conveying screw normally includes an axis portion, and a spiral (blade portion) that is formed in a spiral shape in the axial direction on the outer circumferential portion of the axis portion.

In this type of developing device, for example, in which storing toner is a one-component system developer, as toner is being mixed and conveyed by the mixing conveying screw, fluidity is lost due to wax or surface treating agent on the toner surface being gradually stripped away, and the like. Thus, the toner may attach and accumulate on the spiral of the mixing conveying screw. In this kind of situation, the mixing and conveying functions of the mixing conveying screw are being hindered.

Consequently, as a conventional developing device, there has been a device known which the shape of the spiral is improved so that toner will be less likely to attach thereon as shown in Japanese Patent Application Publication No. 2000-250299. The spiral shown in JP2000-250299 is designed to have both the mixing and the conveying functions.

In addition, there is a technology known for scraping off toner attached on a layer thickness control blade for controlling the thickness of toner layer on the developing roller as shown in Japanese Patent Application Publication No. 2001-249538.

Meanwhile, an electrophotographic image forming device further has a cleaning device for removing toner remaining on the surface of a photosensitive drum, around the photosensitive drum. The cleaning device is normally made of a cleaning blade that is in contact with the surface of the photosensitive drum, and a mixing conveying screw for mixing and conveying in one direction toner that is scraped off by the cleaning blade. In the cleaning device also, toner may attach to the mixing conveying screw, in the same manner as the developing device. Therefore, there is a device known with a film made of polyethylene terephthalate mounted on the mixing conveying screw to extend radially from the axis, to scrape off the toner.

As with the developing device in JP2000-250299, in the method for improving the shape of the spiral, the shape of the spiral becomes complicated, and even by improving the shape, it still cannot sufficiently prevent toner from attaching to it.

In addition, as with the above described cleaning device, in the technology adopting the resinous film, it is possible to scrape off toner attached on the spiral, but this hinders the function of conveying toner. Therefore, when adopting this technology in a developing device, functions that should be included in a developing device cannot be sufficiently secured.

In view of the above, it will be apparent to those skilled in the art from this disclosure that there exists a need for an improved developing device and an image forming device having the developing device. This invention addresses this need in the art as well as other needs, which will become apparent to those skilled in the art from this disclosure.

SUMMARY OF THE INVENTION

An object of the present invention is to suppress the degradation of the mixing function and conveying function of a developing device having a mixing conveying member because of developer attaching on the mixing conveying member, and lower the cost required to provide a developing device having such a configuration.

In addition, an object of the present invention is to suppress the degradation of the mixing function and conveying function of a developing device having a mixing conveying member because of developer attaching on the mixing conveying member, and to prevent static electricity from accumulating with such a configuration.

A developing device according to a first aspect of the present invention has a casing, a first mixing conveying member, and a developer removing unit. The casing is configured to store developer. The first mixing conveying member has a first shaft portion arranged to be able to rotate freely in the interior of the casing, and a first blade portion having a spiral shape formed on the outer circumference portion of the first shaft portion. The developer removing unit has a plurality of first scrape members that are arranged lined up in the axial direction corresponding to the spiral pitch of the first blade portion and are able to contact the first blade portion, and a retaining member that is retained in the casing and retains the plurality of the first scrape members.

In this developing device, developer attached on the first blade portion of the first mixing conveying member is scraped off by the contact of each of the plurality of the first scrape members retained in the retaining portion with the first blade portion at the corresponding positions in the axial direction, along with the rotation of the first mixing conveying member. Therefore, it is possible to prevent developer from attaching and accumulating on the first mixing conveying member.

Furthermore, each of the first scrape members is a separate body from the other. Therefore, it is possible to create them individually corresponding to the shape of the blade portion in the position that it is to be arranged in the axial direction. For example, these members can be easily created, compared to the case that the plurality of the first scrape members is created as one member, and it is possible to reduce the cost.

A developing device according to a second aspect of the present invention is the developing device of the first aspect, wherein the device further includes a second mixing conveying member that is parallel with the first mixing conveying member and made of a second shaft portion arranged to be able to rotate freely in the interior of the casing, and a second blade portion having a spiral shape and formed on the outer circumference portion of the second shaft portion. The developer removing unit further has a plurality of second scrape members arranged to be lined up in the axial direction corresponding to the spiral pitch of the second blade portion. Each of the second scrape members is configured to contact the second blade portion, and the second scrape members are retained in the retaining member.

In this developing device, especially in a device with a mixing conveying system, developer attached on the two mixing conveying members is scraped off by the first scrape member and the second scrape member. Here, each of the first and the second scrape members can be created individually corresponding to the positions in which they will be placed. Thus, these members can be easily created, and it is possible to reduce the cost.

A developing device according to a third aspect of the present invention is the developing device of the second aspect, wherein each of the two mixing conveying members further includes a plate portion that is formed on the outer circumferential portion of a tip portion in the conveying direction of the shaft portion and extends in the radial direction to convey developer to the side of the other mixing conveying member.

In this developing device, since developer is transferred from one mixing conveying member to the other mixing conveying member by the plate portion, the circulating efficiency is improved.

A developing device according to a fourth aspect of the present invention is the developing device of the first aspect, wherein each of the plurality of the scrape members is formed by metal wire rod. Further, the metal wire rod is preferably elastic.

In this developing device, each of the scrape members is formed by an elastic metal wire rod, and is able to follow even the movement of and to contact the blade portion that moves in the axial direction due to the rotation of the mixing conveying member. Thus, developer attached to the blade portion can be more reliably scraped off.

An image forming device according to a fifth aspect of the present invention has an image carrier, a developing device, and a transfer device. The developing device is the device of the first aspect that supplies developer to the image carrier. The transfer device transfers developer supplied to the image carrier to a recording medium.

A developing device according to a sixth aspect of the present invention has a casing, a first mixing conveying member, a conductive member, and a developer removing unit. The casing is able to store developer. The first mixing conveying member includes a first shaft portion arranged to be able to rotate freely in the interior of the casing, and a first blade portion having a spiral shape formed on the outer circumference portion of the first shaft portion. The conductive member is mounted to the casing. The developer removing unit has a first scrape member that is able to contact the first blade portion and is in contact with the conducting member, and a retaining member mounted to the casing and retains the first scrape member.

In this developing device, developer attached to the first blade portion of the first mixing conveying member is scraped off by the contact of the first scrape member retained to the retaining portion to the first blade portion, along with the rotation of the first mixing conveying member. Therefore, it is possible to prevent developer from attaching to and accumulating on the first mixing conveying member.

Along with this kind of scraping operation, in the first scrape member, static electricity may be charged due to friction between developer and the like. However, since it is grounded at the conductive member, it is kept at the same potential as the electrical potential at the side of the casing, and it is possible to prevent the accumulation of the static electricity. Therefore, the accumulated static electricity is discharged, and it is possible to avoid bad influences even effecting developing operation with the induction of noise.

A developing device according to a seventh aspect of the present invention is the device of the sixth aspect, wherein the developing device further has a developer carrier, and a developing bias input portion. The developer carrier is arranged to be able to rotate freely in the interior of the casing and supplies developer to an image carrier of an image forming device. The developing bias input portion is mounted to the casing, in which a predetermined developing bias to be applied to the developer carrier is inputted. Further, the developing bias input portion is conducted with the conductive member.

As a method of allowing static electricity accumulated in the scrape member to escape, for example, one can consider a grounded connection at a member on the side of the image forming device. However, since the scrape member is in the interior of the casing, developing bias may leak with this kind of method. However, in this developing device, the scrape member is grounded at the conductive member and the developing bias input portion. As a result, it is possible to maintain same potential with the developing bias. As a result, it is possible to suppress leak of developing bias and the occurrence of noise. In addition, since the scrape member has the same potential as the developing bias, it is possible also to prevent developer from attaching to the scrape member itself.

A developing device according to an eighth aspect of the present invention is the device of the sixth aspect, wherein the plurality of first scrape members is arranged to be lined up in the axial direction corresponding to the spiral pitch of the first blade portion. In addition, the conductive member extends in the axial direction along the first mixing conveying member. Since it is possible to create each scrape member individually, it is possible to create easily each member in a shape that is suitable to avoid the accumulation of static electricity.

A developing device according to a ninth aspect of the present invention is the device of the sixth aspect, wherein the device further includes a second mixing conveying member that is parallel with the first mixing conveying member and made of a second shaft portion arranged to be able to rotate freely in the interior of the casing, and a second blade portion formed on the outer circumference portion of the second shaft portion. Furthermore, the developer removing unit further includes a second scrape member that is able to contact the second blade portion and in contact with the conductive member, the retaining member further retains the second scrape member.

In this developing device, especially in a device with a mixing conveying system, developer attached on the two mixing conveying members will be scraped off by the first scrape member and the second scrape member.

A developing device according to a tenth aspect of the present invention is the device of the sixth aspect, wherein the scrape member is formed by an elastic metal wire rod. In this developing device, by using this kind of scrape member, it becomes easy for static electricity to accumulate. However, since it is grounded at the conductive member, it is possible to avoid static electricity being accumulated and discharged.

A developing device according to an eleventh aspect of the present invention includes an image carrier, a developing device, and a transfer device. The developing device is the device of the sixth aspect that supplies developer to the image carrier. The transfer device transfers developer supplied to the image carrier to a recording medium.

According to the present invention, it is possible to prevent developer from attaching and accumulating on the first mixing conveying member because developer attached to the first blade portion of the first mixing conveying member is scraped off by the contact of each of the plurality of the first scrape members attached to the retaining portion with the first blade portion in their corresponding positions in the axial direction, along with the rotation of the first mixing conveying member. In addition, each first scrape member is a separate body from the other, and thus, it is possible to create them individually according to the shape of the blade portion at the position that they will be placed in the axial direction. For example, these members can be easily created, compared to the case of creating the plurality of the first scrape members as one member, and it is possible to reduce the cost.

In addition, according to the present invention, developer attached on the first blade portion of the first mixing conveying member is scraped off by the contact of the first scrape member retained in the retaining portion with the first blade portion, along with the rotation of the first mixing conveying member. Therefore, it is possible to prevent developer from attaching and accumulating on the first mixing conveying member. Along with this kind of scraping operation, in the first scrape member, static electricity may be charged due to friction between developer and the like. However, since it is grounded at the conductive member, it is kept at the same potential as the electrical potential at the side of the casing. Thus, it is possible to prevent the accumulation of the static electricity. Therefore, the accumulated static electricity is discharged, and it is possible to avoid bad influences even effecting developing operation with the induction of noise.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Configuration of an Image Forming Device

Figure 1:
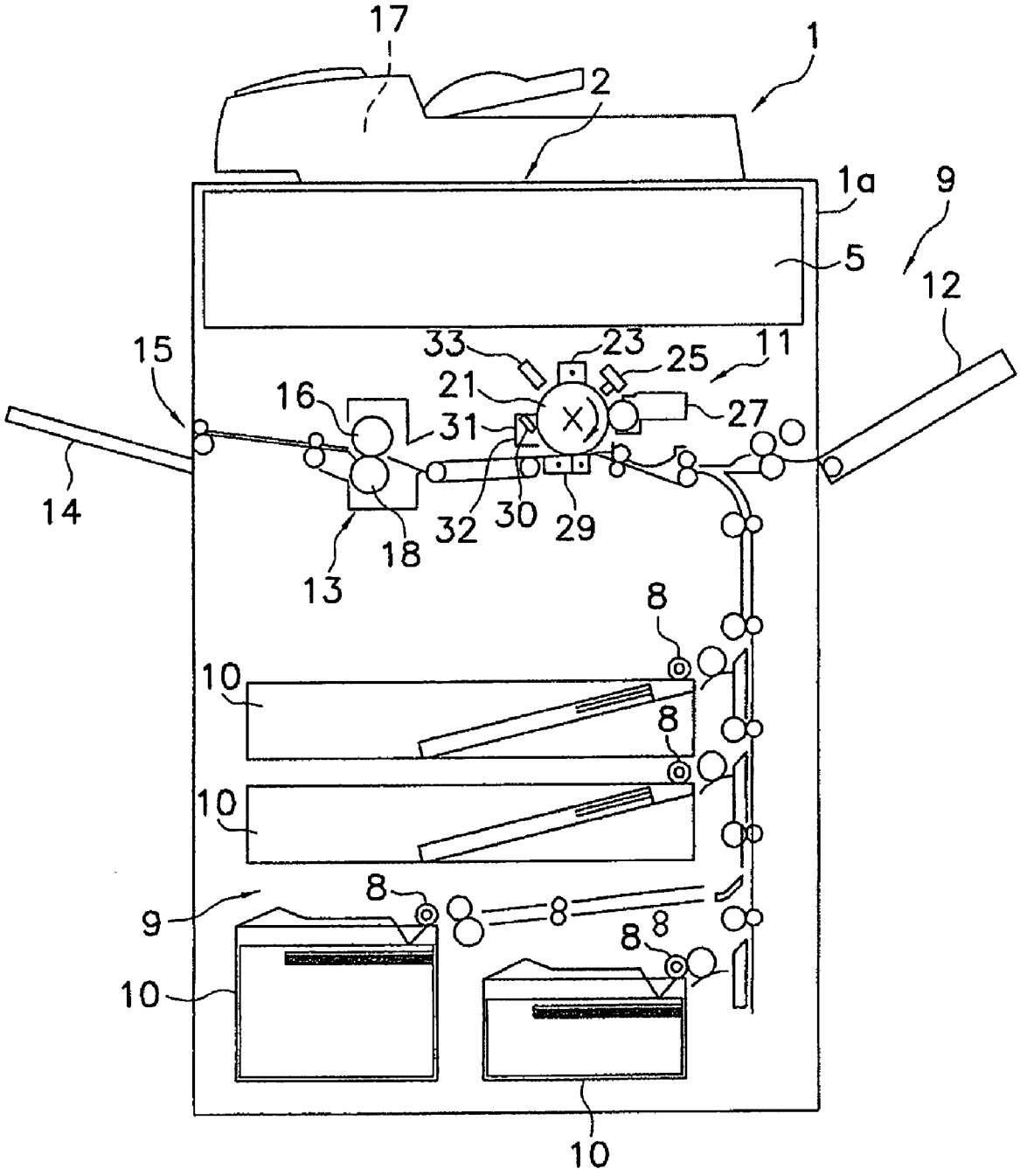
FIG. 1 is a longitudinal cross-sectional view showing a multifunction device in accordance with a preferred embodiment of the present invention.

FIG. 1 shows a multifunction device 1 as an image forming device in accordance with a first preferred embodiment of the present invention. The multifunction device 1 is an image forming device simultaneously having functions as a copying machine, a printer, a fax machine, and as a scanner. The multifunction device 1 is made of an operation panel (not shown in the figure), an image scanning unit 5, a control unit (not shown in the figure), a paper feeding unit 9, an image forming unit 11, a fixing unit 13, and a discharging unit 15.

The operation panel includes a Start key to give a command to copy or to scan an original document, and a Setting key to set different printing conditions, and the like. In addition, the operation panel includes a touch panel type of liquid crystal display on which various operation screens are displayed.

The image scanning unit 5 is configured to scan image information of the original document on a document table 2 above the main body 1*a* of the multifunction device 1, and has an optical system, CCD, which are not shown in the figure, and the like.

The control unit is made of a microcomputer that is made of a CPU, RAM, ROM, and the like. The control unit is configured to control input and output units of the image scanning unit 5, the image forming unit 11, and the like, and perform image processing and the like with respect to image information. Various program data are stored in the ROM to perform these operations, and these program data are retrieved by the CPU for RAM, and executed.

The paper feeding unit 9 includes a plurality of paper cassettes 10 arranged at the bottom of the main body 1*a* of the multifunction device, a manual feed tray 12 arranged on a side portion of the main body 1*a* of the multifunction device, paper feeding rollers 8 to convey papers (recording media) set in the cassettes and tray toward the image forming unit 11 one sheet at a time, and a driving motor (not shown in the figure) that drives the paper feeding rollers.

The image forming unit 11 is configured to form toner image on a sheet of paper conveyed from the paper feeding unit 9 by electrophotographic process. The image forming unit 11 includes a photosensitive drum 21 (image carrier) that is driven to rotate in a predetermined rotation direction (arrow X direction), a main charging device 23, an exposure device 25, a developing device 27, a transfer device 29, a cleaning device 31, and a neutralization device 33 that are arranged around the photosensitive drum 21 in this order from the upstream side in the rotation direction.

The photosensitive drum 21 is a rotating body having a photosensitive layer on the surface thereof, and rotates at a predetermined rotating speed when receiving an image forming command.

The main charging device 23 has a charged wire to which high power voltage is applied. Further, a predetermined potential is applied on the surface of the photosensitive drum 21 via corona discharge by this charged wire to allow the photosensitive drum 21 to be evenly charged.

The exposure device 25 has a laser light source, a polygon mirror, and the like, and by irradiating laser light on the charged photosensitive drum 21 based on the image information, the surface potential of the photosensitive drum 21 is selectively decayed, and an electrostatic latent image is formed.

The developing device 27 provides toner to the photosensitive drum 21. Further, the developing device 27 makes the electrostatic latent image on the surface of the photosensitive drum 21 appear. Details will be described later.

The transfer device 29 is configured to transfer the toner image formed on the surface of the photosensitive drum 21 onto a sheet via transfer bias.

The cleaning device 31 has a casing 32, a cleaning blade 30 that is in contact with the surface of the photosensitive drum 21, a mixing conveying screw (not shown in the figure) to convey toner that is scraped off in the interior of the casing 32 to one side in the axial direction (to the back with respect to the paper, in FIG. 1). The cleaning device 31 scrapes off toner remaining on the surface of the photosensitive drum 21 and recovers the toner.

The neutralization device 33 is configured to neutralize the remaining electrical potential on the surface of the photosensitive drum 21.

The fixing unit 13 is arranged on the downstream side in the sheet conveying direction of the image forming unit 11, and is made of a heating roller 16 having a built-in heater, and a pressure roller 18. The sheet having a toner image transferred thereon is nipped by the two rollers 16 and 18, and as a result, the toner image is melted and fixed.

The discharging unit 15 is configured to discharge the sheet that passed through the fixing unit 13 to the discharging tray 14 on a side of the main body 1*a* of the multifunction device. The discharging unit has a roller, a driving motor that drives it, and the like.

In addition, the multifunction device 1 further includes an automatic document feeder 17, a toner supplier (not shown in the figure), and the like, as other input output units. The automatic document feeder 17 is attached to be able to open and to close freely with respect to the upper surface of the main body 1*a* of the multifunction device, and is able to feed a plurality of original sheets continuously one sheet at a time to the document table 2. The toner supplier is configured to supply toner from a toner cartridge (not shown in the figure) arranged above the developing unit 27, and performs a supply operation when a remaining amount detection sensor (not shown in the figure) of the developing unit 27 detects that the amount of toner remaining has dropped below a predetermined amount.

Developing Device

Next, based on FIGS. 2 and 3, the developing device 27 will be described in detail.

Figure 3:
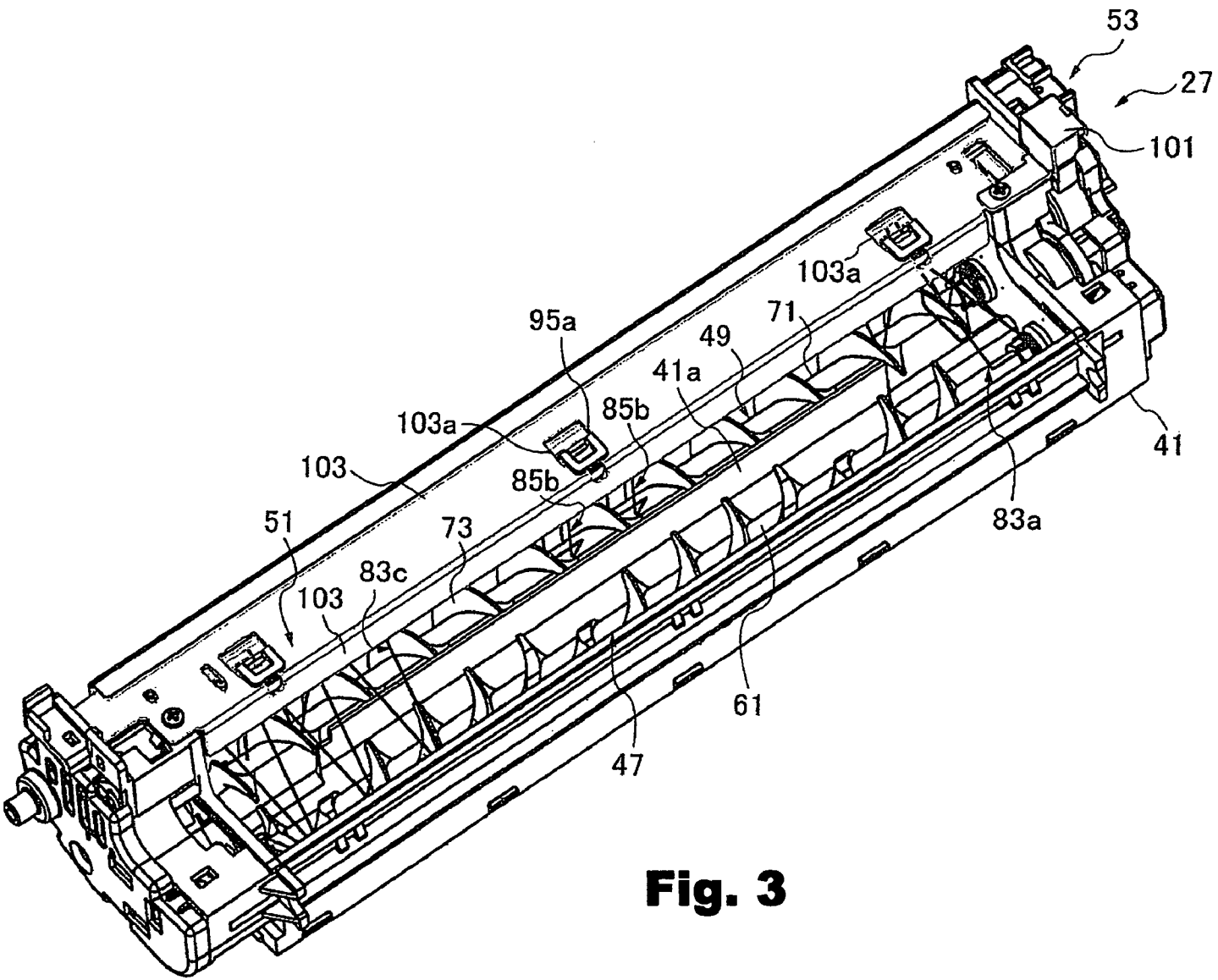
FIG. 3 is a perspective view showing the developing device with a portion thereof removed for illustrative purposes.

Furthermore, in FIG. 3, the upper portion of the back end portion of the developing device 27 is not shown for the convenience of explanation.

The developing device 27 is configured to develop images using toner as a one-component system developer, and includes a casing 41, a developing roller 43, a layer thickness control blade 45, first and second mixing conveying screws 47 and 49 (a first and a second mixing conveying members), a developer removing unit 51, and a developing bias applying device 53.

The casing 41 is a chassis preferably made of resin, and stores toner in the interior thereof. The casing 41 is open at the front end portion, and at the same time, the upper portion of the rear end portion and a toner cartridge not shown in the figure are formed to be continuous. In addition, the casing 41 includes a partition wall 41*a* formed to extend across the area in the axial direction except for the two end portions, and extend in the vertical direction between the first and the second mixing conveying screws 47 and 49.

The developing roller 43 is attached to be able to rotate freely at the opening portion at the front end portion of the casing 41, and arranged adjacent to the photosensitive drum 21. The developing roller 43 is configured to supply toner in the interior of the casing 41 to the photosensitive drum 21, and has a developing sleeve 43*a* that drives to rotate in the direction of the arrow C, and a magnet roller 43*b* arranged to be fixed to the inner circumference of the developing sleeve 43*a* and made of a plurality of magnetic poles formed in predetermined positions in the circumference direction. Thus, the developer carrier can be represented by the developing roller 43.

The layer thickness control blade 45 is a member configured to control the thickness of the toner layer supplied to the developing sleeve 43*a*, and is arranged such that the tip thereof is maintained a predetermined distance from the developing sleeve 43*a*.

Figure 2:
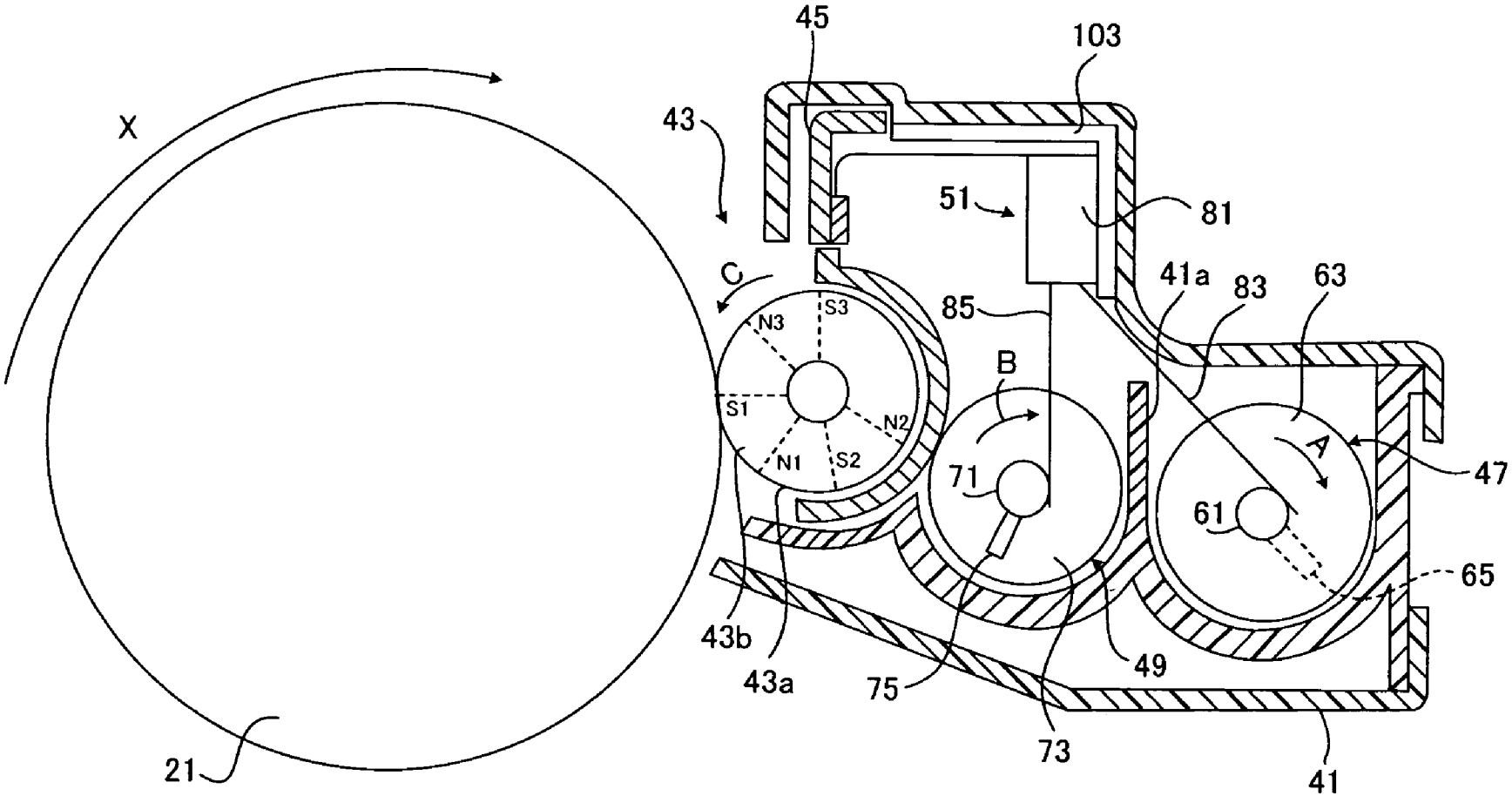
FIG. 2 is a longitudinal cross-sectional view of a developing device of the multifunction device.

The second mixing conveying screw 49 is configured to convey while mixing the toner in the interior of the casing 41 to one side in the axial direction (the direction from the rear side with respect to the paper toward the front side, in FIG. 2), and to circulate and to convey toner in the interior of the casing 41 together with the first mixing conveying screw 47. The second mixing conveying screw 49 is arranged parallel with the first mixing conveying screw 47 via the partition wall 41*a*, and arranged to be able to rotate freely in the direction of the arrow B in the interior of the casing 41. The second mixing conveying screw 49 includes a shaft 71 (second shaft portion), a spiral 73 (second blade portion) that has a spiral shape formed on the outer circumference of the shaft 71, and a plate portion 75 formed on the outer circumference on one end in the axial direction of the shaft 71. The plate portion 75 on the tip in the conveying direction is configured to convey toner to the side of the first mixing conveying screw 47 at one side in the axial direction, and extends to the outer circumference side from the shaft 71.

The first mixing conveying screw 47 is configured to convey while mix toner in the interior of the casing 41 to the other side in the axial direction (the direction from the front side with respect to the paper toward the rear side, in FIG. 2), and is arranged to be able to rotate freely the direction of the in arrow A in the interior of the casing 41. The first mixing conveying screw 47 has a shaft 61 (first shaft portion), a spiral 63 (first blade portion) that is formed having a spiral shape on the outer circumference face of the shaft 61, and a plate portion 65 formed on the outer circumference portion of the tip in the conveying direction of the shaft 61. The plate portion 65 is configured to convey toner to the side of the second mixing conveying screw 49 at the other side in the axial direction, and extends to the outer circumference side from the shaft 61.

Figure 4:
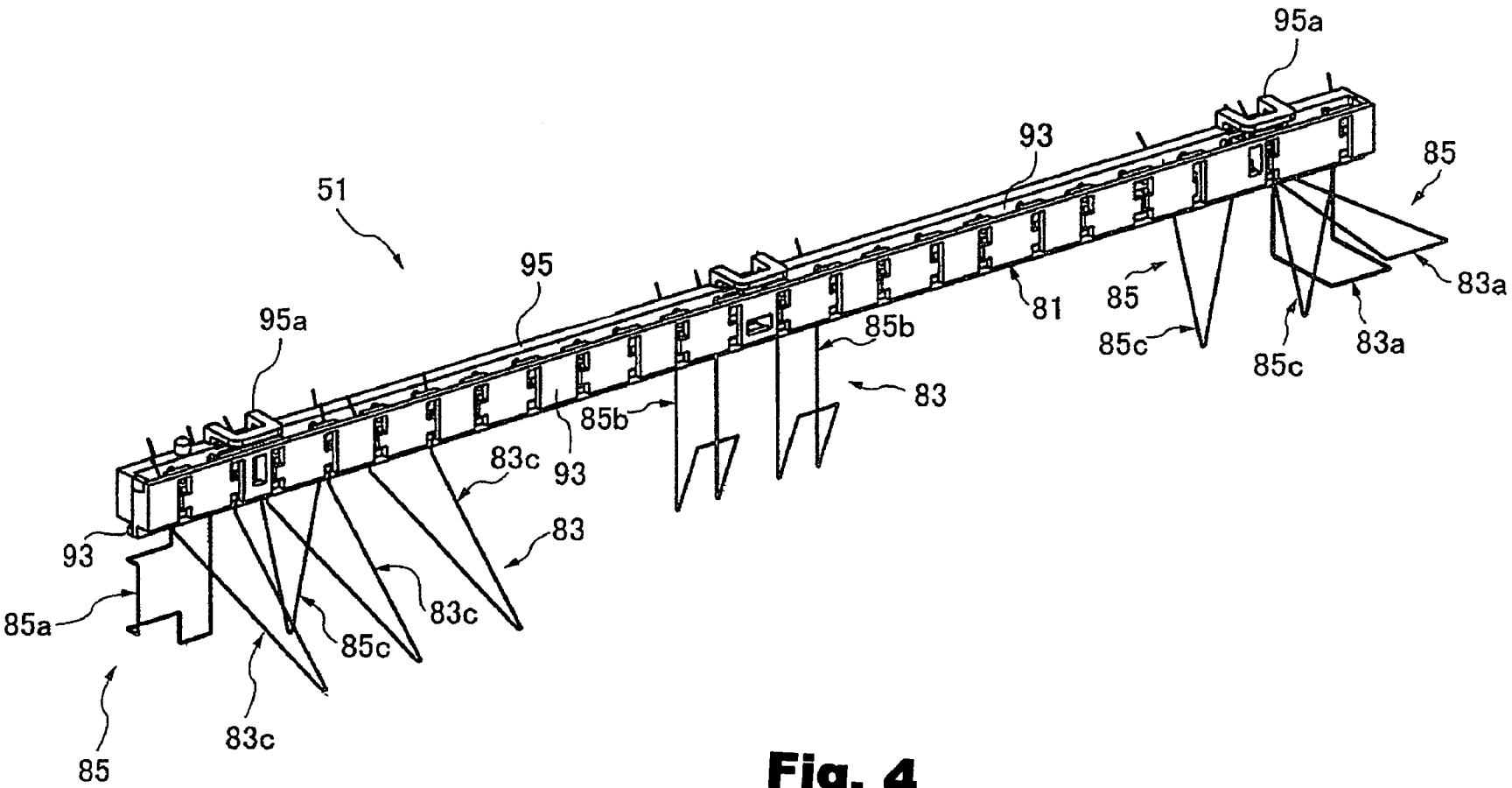
FIG. 4 is a perspective view showing a toner removing unit of the developing device with a portion thereof omitted for illustrative purposes.
Figure 5:
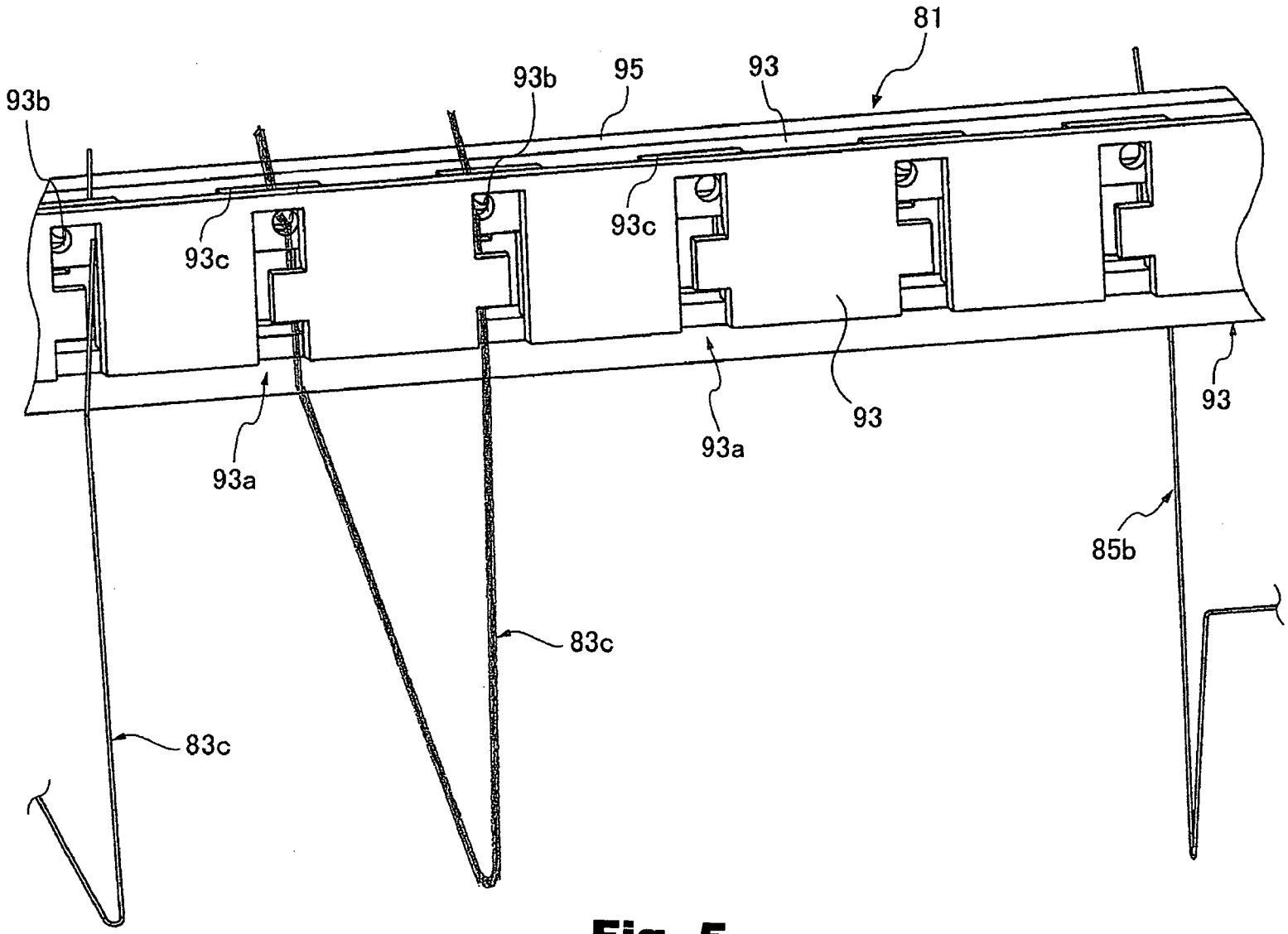
FIG. 5 is an enlarged partial view of the main portions of the toner removing unit of FIG. 4.
Figure 6:
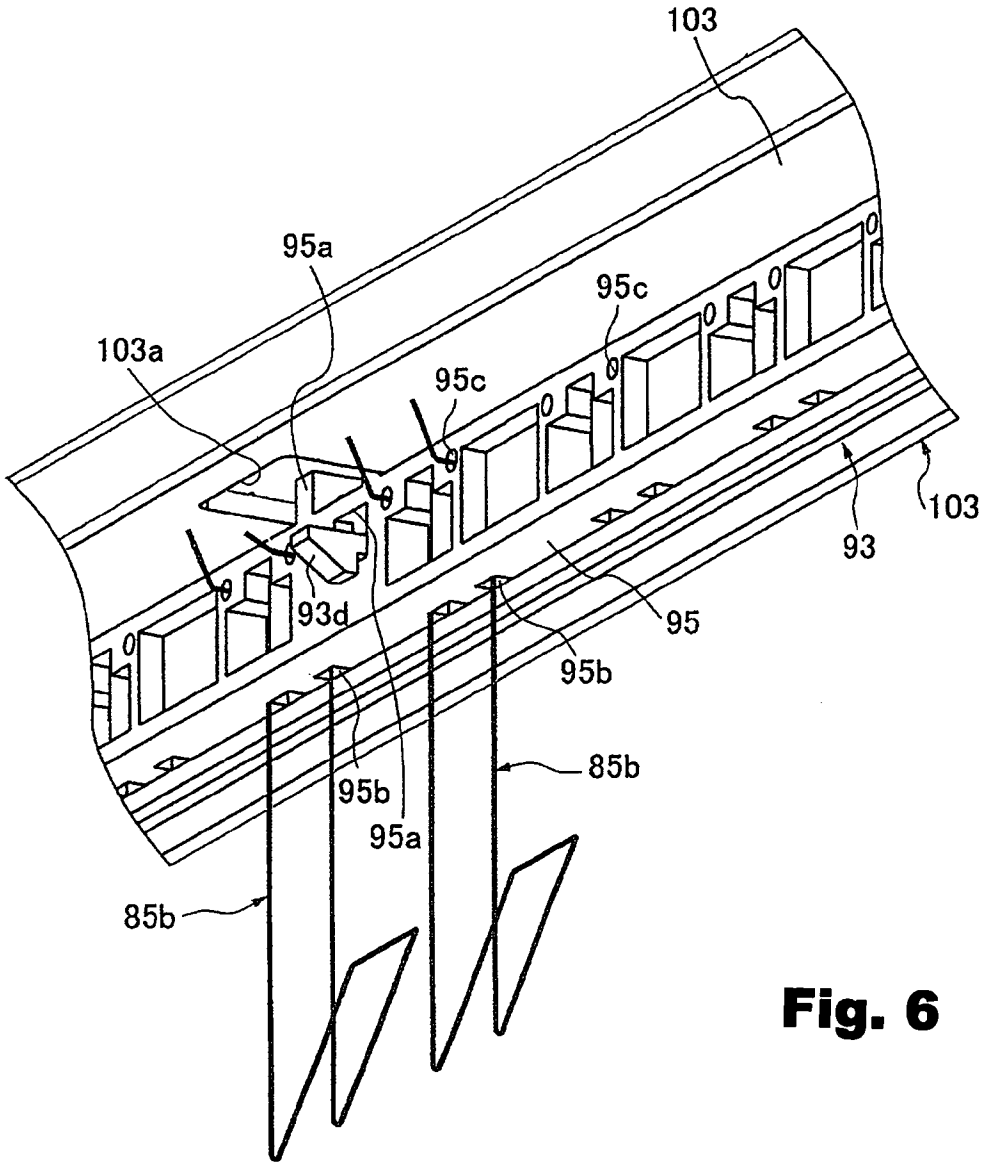
FIG. 6 is a rear perspective view showing the toner removing unit of FIG. 4 with a portion thereof removed for illustrative purposes.

The developer removing unit 51 is arranged in a portion that is positioned a little to the front end side and above the partition wall 41*a* on the upper portion of the casing 41. As shown in FIGS. 4 to 6, the developer removing unit 51 is made of a retaining portion or member 81, a plurality of first spring members 83 (first scrape members), and a plurality of second spring members 85 (second scrape members).

The first and second spring members 83 and 85 are formed by wire rods made of metal (for example, SUS304) having spring or elastic properties. Here, these spring members include three shapes corresponding to areas in the axial direction.

As a first shape, at one end portion in the axial direction of the retaining portion 81, a spring member 85*a* projecting out at the side of the second mixing conveying screw 49 is being retained. In addition, at the other end portion in the axial direction of the retaining portion 81, two spring members 83*a* projecting out from the first mixing conveying screw 47 are being retained in a position of the same axial direction. The tips of each of these spring members 83*a* and 85*a* are formed to have right angles.

As a second shape, a plurality of spring members 85*b* projecting out at the side of the second mixing conveying screw 49 in the area except the two end portions in the axial direction of the retaining portion 81, and a plurality of spring members (not shown in the figure) projecting out at the side of the first mixing conveying screw 47 are being retained. The tips of each of these spring members 85*b* are formed to have right angles and to be folded back, so that these spring members 85*b* can scrape off toner attached to mainly the spirals 63 and 73.

As a third shape, three spring members 85*c* projecting out at the side of the second mixing conveying screw 49 are retained at the other end portion in the axial direction of the retaining portion 81, and next to the spring member 85*a* at one end portion. In addition, at one end portion in the axial direction of the retaining portion 81, three spring members 83*c* projecting at the side of the first mixing conveying screw 49 are arranged. The tips of each of these spring members 83*c* and 85*c* are V-shaped, so that these spring members 83*c* and 85*c* can scrape off toner attached to mainly spirals 63 and 73.

In addition, in FIGS. 3 to 6, for the convenience of explanation, with regard to spring members 83 and 85, even though it is not shown in all of the areas in the axial direction of the retaining portion 81, spring members 85*b* of the above described second type of shape are retained in all of the omitted areas. In addition, with either of the spring members 83 or 85, a pair of edge-in portions is made that is attachable to the retaining portion 81. Each edge-in portion is in contact with a developing stay 103 (described later) of a developing bias applying device 53 from the bottom.

The retaining portion 81 is configured to retain the plurality of the first and second spring members 83 and 85, and is made of a first blade 93 and a second blade 95 that are preferably made of resin and each extend in the axial direction, and connected to each other in the front back direction.

The first blade 93 is arranged at the side of the first mixing conveying screw 47, and fixed by an adhesive, for example, to the back end portion of the developing stay 103. The portion at the back end portion side of the first blade 93 has a comb-like shape, and a plurality of mounting portions 93*a* is formed to which spring member 83*c* and the like can be mounted at predetermined intervals in the axial direction corresponding to the spiral pitch of the first mixing conveying screw 47. In each mounting portion 93*a*, an insertion hole 93*b* is formed in which the edge-in portion of the spring member 83*c* and the like is inserted. In addition, the first blade 93 includes a notch 93*c* formed in a position in the axial direction corresponding to the position of each mounting portion 93*a*. The notch 93*c* guides the edge-in portion of the spring member 83*c* and the like that passes through the insertion hole 93*b* upward. In addition, the first blade 93 includes an engagement protrusion 93*d* to snap fasten with respect to the second blade 95.

The second blade 95 includes an engagement hole 95*a* to snap fasten to the first blade 93 using the engagement protrusion 93*d* of the first blade 93. In the second blade 95, insertion holes 95*b* are formed in which the edge-in portions of spring members 85*b* and the like are inserted, and at the same time, on the face of the front end side, guide holes 95*c* that are in communication with insertion holes 95*b* are formed to guide the edge-in portions of spring members 85*b* and the like to the front end side. In addition, at the upper end of the second blade 95, at three locations of the two end portions in the axial direction and the center portion, engagement portions 95*b* are formed that engage with engagement holes 103*a* of the developing stay 103 of the developing bias applying device 53.

The developing bias applying device 53 includes a developing bias input terminal or portion 101, and the developing stay 103. The developing bias input terminal 101 is configured to apply a predetermined developing bias to the developing roller 43, and is connected to a developing bias power source that is not shown in the figures. The developing stay 103 is a plate member preferably made of metal that extends in the axial direction. The end portion thereof at the front end side is folded orthogonally facing down, and at the same time, an end portion at the rear end side is also folded orthogonally facing down. The developing stay 103 is arranged at the rear end portion side of the first blade 93 and the second blade 95. The developing stay 103 is mounted by a screw cramp on the upper portion on the side of the front end of the casing 41. The developing stay 103 is preferably made of metal (for example, SECC) that conducts with the developing bias input terminal 101. Further, when developing bias is applied to the developing bias input terminal 101, the electrical potential thereof becomes the same as the developing bias. In addition, the developing stay 103 is configured such that static electricity does not accumulate in the spring members 83 and 85 by the contact of the edge-in portions of each of the spring members 83 and 85. Thus, the developing stay 103 is a conductive member.

Operation of the Image Forming Device

Next, the operation of the multifunction device 1 will be described.

Referring to FIG. 1, when the power of the multifunction device 1 is turned on, various perimeters in the control unit are initialized, a heater of the fixing unit 13 is heated, and an initial operation is executed. When the initial operation is terminated, a predetermined print standby screen is displayed on the operation panel.

In this state, for example, an original is placed on the document table 2, and when the Start key is depressed, image information of the original is scanned and at the same time, a sheet is fed from the paper cassettes 10. At this time, in the image forming unit 11, the photosensitive drum 21 is being driven to rotate, and after being charged, an electrostatic latent image is formed based on the scanned image information after exposure. Next, a toner image is formed after toner is supplied from the developing device 27. Then, at a predetermined timing, the sheet is conveyed to the image forming unit 11, and the toner image is transferred from the photosensitive drum 21. The sheet with the toner image transferred thereon is further conveyed downstream, and by passing through the fixing unit 13, toner image is melted and fixed, and the sheet is discharged onto the discharging tray 14 by the discharging unit 15.

Referring now to FIGS. 2 and 3, in between this series of image forming operations, in the interior of the developing device 27, two mixing conveying screws 47 and 49 convey toner in reversed directions with each other while mixing the toner, and by doing so, toner is circulated and conveyed in the interior of the casing 41 and a portion thereof is supplied to the developing roller 43 from the first mixing conveying screw 47. When this operation is repeated, wax or surface treating agent or the like on the surface of the toner is stripped off, and in the case that fluidity is increasingly degraded, toner will be attached to and may accumulate on the spirals 63 and 73 of each of the mixing conveying screws 47 and 49. However, in this developing device 27, spring members 83 and 85 are in contact with the spirals 63 and 73, and scrape off toner. Therefore, attachment and accumulation of toner is suppressed, and as a result, it is possible to avoid the two mixing and conveying functions of each of the mixing conveying screws 47 and 49 from being inhibited.

Furthermore, each of the spring members 83 and 85 are different bodies. It is possible to mount them separately when assembling the toner removing unit, as well as create them separately depending on the position to be mounted. Therefore, it becomes easy to create these members to have shapes that are different from each other, for example, compared to a case of connecting and creating spring members 83*a*, 85*b*, and 83*c* by one wire rod, a metal mold of a simple shape can be used, and it is possible to reduce the cost.

In addition, since it is possible to create the spring members separately, for example, it can be used also in a developing device of another image forming device, other than the multifunction device 1, and can be commoditized for various models. Therefore, by doing so, cost can be reduced.

Other Embodiments (a) The place of arrangement, the type, and the shape of the scrape member are not limited to ones described in the above embodiment, and can be determined according to the spiral pitch and the shape of the mixing conveying member.

(b) The developing stay is not limited to a metal developing stay, and can be formed with another material such as conductive resin, and the like, as long as it is made of a conductive material and conductive with the developing bias applying device.

(c) The developing device is not limited to a developing device of the type that circulates and mixes, and can be a developing device having only one mixing conveying member. In this case, in the retaining portion, only a first scrape member is retained.

(d) Developer that is stored in the developing device is not limited to a one-component developer, and can be a two-component developer. Furthermore, it can be magnetic or nonmagnetic.

(e) The image forming device is not limited to a multifunction device, and it can be a copying machine, a printer, or a fax machine.

(f) The configuration of the retaining portion is not limited to the one described in the above embodiment, for example, the configuration can be such that the first plate can be a member made of metal that is integral with the developing stay.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of an image forming device equipped with the present invention. Accordingly, these terms, as utilized to describe the present invention should be interpreted relative to an image forming device equipped with the present invention as normally used. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A developing device, comprising:

a casing configured to store developer;

a first mixing conveying member having a first shaft portion arranged to rotate freely in the interior of the casing, and a first blade portion having a spiral shape formed on an outer circumferential portion of the first shaft portion;

a second mixing conveying member parallel to the first mixing conveying member, the second conveying member having a second shaft portion arranged to rotate freely in the interior of the casing, and a second blade portion formed on the outer circumference portion of the second shaft portion; and a developer removing unit including a plurality of first scrape members aligned in an axial direction corresponding to a spiral pitch of the first blade portion and configured to contact the first blade portion, a plurality of second scrape members aligned in the axial direction corresponding to the spiral pitch of the second blade portion and configured to contact the second blade portion, and a retaining member mounted to the casing and configured to retain the plurality of the first scrape members and the plurality of the second scrape members.

2. The developing device according to claim 1, wherein each of the conveying members further includes a plate portion that is formed on the outer circumference portion of a tip portion in the conveying direction of the respective shaft portion and extends in the radial direction to convey developer to the side of the other mixing conveying member.

3. The developing device according to claim 1, wherein each of the plurality of the scrape members is formed by an elastic metal wire rod.

4. An image forming device, comprising:

an image carrier;

a developing device configured to supply developer to the image carrier, the developing device including a casing configured to store developer, a first mixing conveying member having a first shaft portion arranged to rotate freely in the interior of the casing, and a first blade portion having a spiral shape formed on an outer circumferential portion of the first shaft portion, a second mixing conveying member parallel to the first mixing conveying member, the second conveying member having a second shaft portion arranged to rotate freely in the interior of the casing, and a second blade portion formed on the outer circumference portion of the second shaft portion, and a developer removing unit including a plurality of first scrape members aligned in an axial direction corresponding to a spiral pitch of the first blade portion and configured to contact the first blade portion, a plurality of second scrape members aligned in the axial direction corresponding to the spiral pitch of the second blade portion and configured to contact the second blade portion, and a retaining member mounted to the casing and configured to retain the plurality of the first scrape members and the plurality of the second scrape members; and a transfer device configured to transfer developer supplied to the image carrier to a recording medium.

5. The developing device according to claim 4, wherein the plurality of first scrape members have different shapes that correspond to areas of contact around the spiral pitch of the first blade portion.

6. A developing device, comprising:

a casing configured to store developer;

a first mixing conveying member having a first shaft portion arranged to rotate freely in the interior of the casing, and a first blade portion having a spiral shape formed on the outer circumference portion of the first shaft portion;

a conductive member mounted to the casing;

a developer removing unit having a first scrape member configured to contact the first blade portion and the conductive member, and a retaining member mounted to the casing and configured to retain the first scrape member;

a developer carrier arranged to rotate freely in the interior of the casing and supplies developer to an image carrier of an image forming device; and a developing bias input portion mounted to the casing, in which a predetermined developing bias to be applied to the developer carrier is inputted, and the developing bias input portion is conducted by the conductive member.

7. The developing device according to claim 6, wherein the first scrape member includes a plurality of first scrape members aligned in the axial direction corresponding to the spiral pitch of the first blade portion, and the conductive member extends in the axial direction along the first mixing conveying member.

8. The developing device according to claim 6, further comprising a second mixing conveying member that is parallel to the first mixing conveying member and made of a second shaft portion arranged to rotate freely in the interior of the casing, and a second blade portion formed on the outer circumference portion of the second shaft portion, wherein the developer removing unit further includes a second scrape member configured to contact the second blade portion and to contact the conductive member, the retaining member further retains the second scrape member.

9. The developing device according to claim 6, wherein the scrape member is formed by an elastic metal wire rod.

10. An image forming device, comprising:

an image carrier;

a developing device configured to supply developer to the image carrier, the developing device including a casing configured to store developer, a first mixing conveying member having a first shaft portion arranged to rotate freely in the interior of the casing, and a first blade portion having a spiral shape formed on the outer circumference portion of the first shaft portion, and a developer removing unit having a first scrape member configured to contact the first blade portion, and a retaining member mounted to the casing and configured to retain the first scrape member;

a transfer device configured to transfer developer supplied to the image carrier to a recording medium;

a developer carrier arranged to rotate freely in the interior of the casing and supplies developer to an image carrier of an image forming device; and a developing bias input portion mounted to the casing, in which a predetermined developing bias to be applied to the developer carrier is inputted, and the developing bias input portion is conducted by the conductive member.

11. The image forming device according to claim 10, further comprising a conductive member mounted to the casing and in contact with the first scrape member so as to prevent static electricity from accumulating in the first scrape member.

12. A developing device for use in an image forming device, comprising:

a casing configured to store developer;

a first mixing conveying member having a first shaft portion arranged to rotate freely in the interior of the casing, and a first blade portion having a spiral shape formed on the outer circumference portion of the first shaft portion;

a conductive member having a planar-shape and mounted to the casing; and a developer removing unit including a plurality of first scrape members having different shapes and aligned in an axial direction corresponding to a spiral pitch of the first blade portion, each of the scrape members includes an elastic metal wire rod with a front end portion and a rear end portion, the front end portion being arranged to contact the first blade portion and the rear end portion being in contact with the conductive member, and a retaining member mounted to the casing and configured to retain the first scrape member.

13. The developing device according to claim 12, wherein the different shapes correspond to areas of contact around the spiral pitch of the first blade portion.

14. The developing device according to claim 12, wherein the conductive member is adapted to prevent static electricity from accumulating in the plurality of first scrape members.

15. The developing device according to claim 12, wherein the conductive member is a rectangular plate.

* * * * *